US006694748B2

(12) United States Patent
Sergio et al.

(10) Patent No.: US 6,694,748 B2
(45) Date of Patent: Feb. 24, 2004

(54) REFRIGERATED BEVERAGE DISPENSER PROVIDED WITH A SANITIZING DEVICE

(76) Inventors: Massimo Sergio, Via Mirandola, 13, I-47900, Rimini (IT); Fiorenzo De Lucia, Via Prov, San Marini, 1136, I-47826, Verucchio (Rimini) (IT)

( * ) Notice: Subject to any disclaimer, the term of this patent is extended or adjusted under 35 U.S.C. 154(b) by 0 days.

(21) Appl. No.: 10/296,697

(22) PCT Filed: May 28, 2001

(86) PCT No.: PCT/IT01/00272

§ 371 (c)(1),
(2), (4) Date: Mar. 18, 2003

(87) PCT Pub. No.: WO01/92143

PCT Pub. Date: Dec. 6, 2001

(65) Prior Publication Data

US 2003/0159447 A1 Aug. 28, 2003

(30) Foreign Application Priority Data

May 29, 2000 (IT) ..... MI2000A1189

(51) Int. Cl.[7] ..... F25B 21/02; B67D 5/62

(52) U.S. Cl. ..... 62/3.64; 62/389; 222/146.6

(58) Field of Search ..... 62/3.64, 177, 125, 62/150, 93, 271, 384; 222/146.6

(56) References Cited

U.S. PATENT DOCUMENTS

| | | | | | |
|---|---|---|---|---|---|
| 3,898,861 | A | * | 8/1975 | McMillin | 62/177 |
| 5,421,159 | A | * | 6/1995 | Stokes | 62/3.64 |
| 6,032,571 | A | * | 3/2000 | Brous et al. | 99/277.2 |
| 6,058,718 | A | * | 5/2000 | Forsberg et al. | 62/125 |
| 6,370,884 | B1 | * | 4/2002 | Kelada | 62/3.64 |
| 6,546,737 | B1 | * | 4/2003 | Heyes et al. | 62/3.64 |
| 2002/0102182 | A1 | * | 8/2002 | Suddath et al. | 422/26 |

* cited by examiner

*Primary Examiner*—William C. Doerrler
(74) *Attorney, Agent, or Firm*—Hedman & Costigan, P.C.

(57) ABSTRACT

The present invention relates to a refrigerated beverage dispenser, specifically designed for delivering fruit juicies, tea, mineral water, wine and the like, which comprises an inlet (1) for water or drink to be delivered, downstream of which is arranged a refrigerating device (2). On the delivering duct a pump (3) and a solenoid valve (4), controlled by a central processing unit (10), are applied. Moreover, a sanitizing auxiliary device (30), controlled by said central processing unit (10) is also provided.

1 Claim, 1 Drawing Sheet

REFRIGERATED BEVERAGE DISPENSER PROVIDED WITH A SANITIZING DEVICE

BACKGROUND OF THE INVENTION

The present invention relates to a refrigerated beverage dispenser for delivering fruit juices, tea, mineral water, wine and the like.

Prior beverage automatic dispensing devices are already known which, however, are very complex construction wise and are not suitable to provide a homogeneous delivering of beverages, which can be either prepared before or at the time of the delivering operation, by using a concentrated product.

Furthermore, prior beverage delivering device do not provide optimum hygienic characteristics, mainly at the delivering outlets or spouts, which are exposed to people.

SUMMARY OF THE INVENTION

Accordingly, the aim of the present invention is to overcome the above mentioned drawbacks, by providing a refrigerated beverage dispenser, specifically designed for delivering fruit juices, tea, mineral water, wine and the like, which is very practical from an operation standpoint and which is suitable to deliver either already prepared beverages, or beverages which are prepared at the delivering time, by using a concentrated product.

Within the scope of the above mentioned aim, a main object of the invention is to provide such a beverage delivering device which is suitable to provide very high hygienic characteristics, and which can be periodically hygienized or sanitized at the delivering nozzle provided for delivering the beverages.

Yet another object of the present invention is to provide such a refrigerated beverage dispenser which is very reliable and safe in operation.

Yet another object of the present invention is to provide such a refrigerated beverage dispenser which can be easily made starting from easily available materials and elements and which, moreover, is very competitive from a mere economic standpoint.

According to one aspect of the present invention, the above mentioned aim and objects, as well as yet other objects, which will become more apparent hereinafter, are achieved by a refrigerated beverage dispenser, specifically designed for delivering fruit juices, tea, mineral water, wines and the like, characterized in that said dispenser comprises an inlet for a beverage to be delivered or water, downstream of which is arranged a refrigerating device and that, on a delivering duct, are applied a central processing unit controlled pump and solenoid valve, an auxiliary hygienizing device, controlled by said central processing unit being moreover provided.

BRIEF DESCRIPTION OF THE DRAWINGS

Further characteristics and advantages of the present invention will become more apparent hereinafter from the following detailed disclosure of a preferred, though not exclusive, embodiment of a refrigerated beverage dispenser, specifically designed for delivering fruit juices, tea, mineral water, wine and the like, which is illustrated, by way of an indicative, but not limitative example, of the figures of the accompanying drawings, where.

DESCRIPTION OF THE PREFERRED EMBODIMENT

Figure 1:
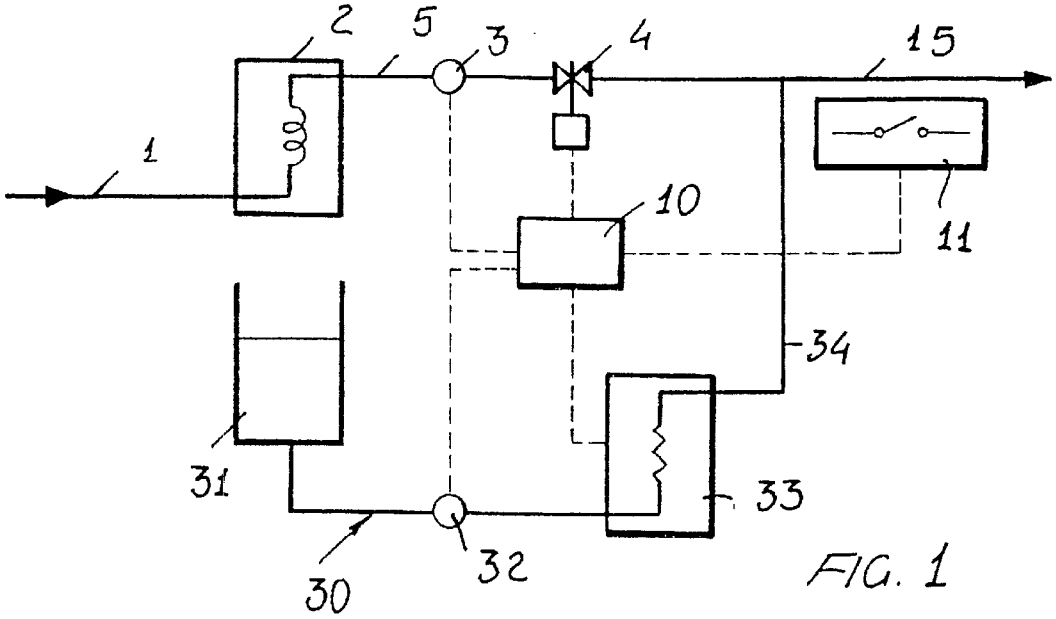
FIG. 1 illustrates an operating diagram of the refrigerating beverage dispenser according to the present invention.

With reference to the number references of the above mentioned figures, and, more specifically to FIG. 1, the refrigerated beverage dispenser, specifically designed for delivering fruit juices, tea, mineral water, wines, and the like, comprises an inlet 1 to be connected either to the water system for introducing into the device drink water directly coming from said water system, by using the inlet or supplying pressure, or to a natural mineral water vessel, as packaged in PET flasks or bottles, or in the so-called bag-in-box packages of 20 liters, to be pumped under pressure to the inlet 1.

To the latter it is possible to connect further vessels holding ready for use products, to be taken by suction.

Downstream of the water or beverage inlet is provided a refrigerating device 2, which is advantageously constituted by a conventional refrigerating circuit, including a compressor, an evaporator, a condenser, a cooling fan or, optionally, a Peltier's cell exchanger and related thermal dissipating devices, cooling fan and a low-voltage power supply.

On the delivery duct 5 exiting the refrigerating device 2, is arranged a pump 3, downstream of which is applied a solenoid valve 4, which is preferably driven by blade types of switches.

Both said pump and said solenoid valve are coupled to a central processing unit 10.

Said central processing unit 10 is operatively coupled to a delivering actuating assembly 11, which can be of any desired types, depending on the use requirements of the delivering device.

The product to be delivered is supplied toward a delivering nozzle, generally indicated by the reference number 15.

Figure 2:
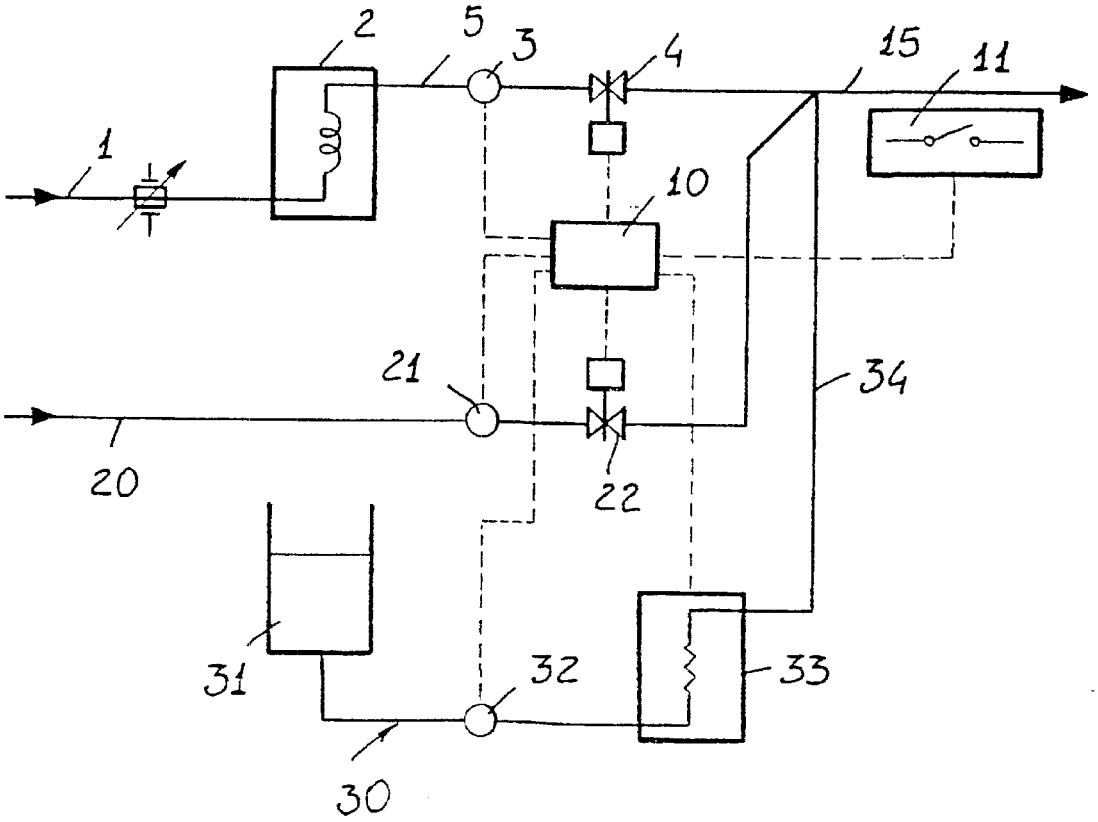
FIG. 2 illustrates an operating diagram of a refrigerated beverage dispenser suitable to mix the products.

To said central processing unit 10, as is clearly shown in FIG. 2, is coupled and inlet 20 for a concentrated product, affected by a concentrated product pump 21 which is provided, downstream thereof, with a solenoid valve 22 for the concentrated product, said solenoid valve being also controlled by said central processing unit.

The concentrate product 20 is coupled to the duct 5, upstream of the delivering nozzles.

With the above disclosed arrangement, it would be possible to mix, with any desired doses, the concentrated product with refrigerated water, so as to deliver the mixed product at the delivering nozzles 15.

The dipping system comprises a food compatible polyethylene tube, having a quick coupled valve for coupling to further vessels, or so-called bag-in-box packages, used both for concentrated products and for wine or other products.

The carbonated water and carbonated wine dispensers, differently from other embodiments of conventional dispensers, use an accumulation tank, the so-called saturating tank, coupled to a low-pressure $CO_2$ bottle, said dispensers being also controlled by the mentioned central processing unit.

More specifically, said central processing unit operates to hold at a desired value the water, wine and gas levels inside the saturating device, and automatically drives a pump for delivering refrigerated water or wine to the saturating device, thereby allowing said refrigerated water or wine to be properly carbonated.

The wine dispensers, on the other hand, directly suck the wine, cool the sucked wine in stainless steel coils, and hold said wine in a refrigerated condition.

The delivery control unit will actuate the pumps and solenoid valves for opening suitably arranged cocks.

In order to assure very high hygienic conditions for all the constructional elements, an auxiliary hygienizing or sanitizing device, generally indicated by the reference number 30, has been moreover provided.

Said sanitizing device comprises a distilled water tank 31, in which is arranged a micropump 32, controlled by said central processing unit 10, for supplying metered water amounts to a boiler 33 where the product is transformed into product steam and sent through the steam duct 34 to a delivery nozzle.

Thus, the exposed to air elements or ducts are fully hygienized.

The operation is automatically managed by a microprocessor, which will actuate a distilled water self-supplied thermal exchanger through said micropump, with preset operating times, after an off settable time of the machine.

From the above disclosure it should be apparent that the invention fully achieves the intended aim and objects.

In particular, a dispenser has been provided, which can be fully automatized, to provide an optimum managing of the delivering both of finished products and of products which are prepared at the delivering time.

The invention, as disclosed, is susceptible to several modifications and variations, all of which will come within the scope of the invention.

Moreover, all the constructional details can be replaced by other technically equivalent elements.

In practicing the invention, the used materials, as well as the contingent size and shapes, can be any, depending on requirements.

What is claimed is:

1. A refrigerated beverage dispenser for delivering fruit juices, tea, mineral water, wine and the like, comprising an inlet for water or a beverage to supplied, downstream of which is arranged a refrigerating device, a beverage delivery duct to which is applied a pump and a solenoid valve, said dispenser also having an auxiliary sanitizing device including a distilled water vessel coupled to a micropump for sending water to a boiler coupled to a product delivery nozzle by a steam duct, said refrigerating device being coupled to a refrigerating circuit including a Peltier exchanger, thermal dissipators, a cooling fan and a low-voltage power supply, a central processing unit for controlling at least said pump, solenoid valve and said refrigerating device, said dispenser further comprising a concentrated product inlet controlled by a concentrate product pump, downstream of which a concentrated product solenoid valve is arranged, said concentrate product pump and said concentrated product solenoid valve being also controlled by said central processing unit, wherein said concentrated product solenoid valve is driven by a blade switch element.

* * * * *

UNITED STATES PATENT AND TRADEMARK OFFICE

CERTIFICATE OF CORRECTION

PATENT NO. : 6,694,748 B2
DATED : February 24, 2004
INVENTOR(S) : Massimo Sergio et al.

It is certified that error appears in the above-identified patent and that said Letters Patent is hereby corrected as shown below:

Title page,
Item [75], inventor's "Fiorenzo De Lucia" information should read:
-- Fiorenzo De Lucia
Via Prov. San Marino, 1136
I-47826, Verucchio (Rimini) - Italy --

Signed and Sealed this

Twenty-second Day of June, 2004

JON W. DUDAS
*Acting Director of the United States Patent and Trademark Office*